US009091965B2

(12) United States Patent
Nakaegawa

(10) Patent No.: US 9,091,965 B2
(45) Date of Patent: Jul. 28, 2015

(54) IMAGE FORMING APPARATUS

(75) Inventor: Tohru Nakaegawa, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 183 days.

(21) Appl. No.: 13/483,632

(22) Filed: May 30, 2012

(65) Prior Publication Data

US 2012/0308272 A1 Dec. 6, 2012

(30) Foreign Application Priority Data

May 31, 2011 (JP) ..... 2011-121915

(51) Int. Cl.
*G03G 15/01* (2006.01)
*G03G 15/16* (2006.01)

(52) U.S. Cl.
CPC ..... *G03G 15/1605* (2013.01); *G03G 15/0189* (2013.01); *G03G 15/1615* (2013.01); *G03G 2215/0132* (2013.01)

(58) Field of Classification Search
CPC ..... G03G 15/0189; G03G 15/1605; G03G 15/1615; G03G 2215/0132
USPC ..... 399/121, 299, 300, 302, 313
See application file for complete search history.

(56) References Cited

U.S. PATENT DOCUMENTS

| | | | | |
|---|---|---|---|---|
| 5,678,150 | A * | 10/1997 | Takahashi et al. | 399/299 |
| 7,428,400 | B2 | 9/2008 | Iwakura et al. | |
| 7,917,071 | B2 | 3/2011 | Hirai et al. | |
| 2005/0063739 | A1 * | 3/2005 | Kobayashi et al. | 399/299 |
| 2005/0084301 | A1 * | 4/2005 | Murakami et al. | 399/313 |
| 2005/0185991 | A1 * | 8/2005 | Iwakura et al. | 399/299 |
| 2006/0210327 | A1 | 9/2006 | Iwakura et al. | |
| 2008/0003022 | A1 * | 1/2008 | Sakashita et al. | 399/303 |
| 2009/0097888 | A1 | 4/2009 | Hirai et al. | |
| 2013/0071149 | A1 * | 3/2013 | Jung et al. | 399/302 |

FOREIGN PATENT DOCUMENTS

| | | |
|---|---|---|
| JP | 2006-259639 A | 9/2006 |
| JP | 2009-20321 A | 1/2009 |
| JP | 2009-98363 A | 5/2009 |

* cited by examiner

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

An image forming apparatus includes a movable intermediary transfer member, a first photosensitive member contacting an outer surface of the intermediary transfer member to form a first nip, a second photosensitive member provided in a downstream direction of the first photosensitive member and contacting the outer surface of the intermediary transfer member to form a second nip, a first transfer roller contacting an inner surface of the intermediary transfer member to form a first contact portion, and a second transfer roller contacting the inner surface of the intermediary transfer member to form a second contact portion. A length of the second contact portion is longer than a length of the first contact portion, measured in the moving direction. In addition, a supporting roller is disposed at the position which is adjacent to and downstream of the second transfer roller with respect to the moving direction and which is shifted in a plane parallel with the moving direction such that its peripheral surface is on an opposite side from the first and second photosensitive members with respect to a common tangent line, adjacent to the intermediary transfer member, between the first photosensitive member and the second photosensitive member.

4 Claims, 7 Drawing Sheets

IMAGE FORMING APPARATUS

FIELD OF THE INVENTION AND RELATED ART

The present invention relates to an image forming apparatus such as a copying machine, a printer, a facsimile machine, a multifunction machine capable of performing one or more functions of the preceding machine, etc., which uses an electrophotographic technology. More specifically, it relates to the structure of an electrophotographic image forming apparatus of the so-called tandem type, that is, an electrophotographic image forming apparatus in which multiple image formation stations are aligned in tandem.

In recent years, in order to form high quality full-color images at a high speed, various full-color image forming apparatuses of the so-called tandem type have been proposed in the field of an image forming apparatus such as a printer, a copying machine, a facsimile machine, or the like. A typical image forming apparatus of the tandem type has four image formation stations for forming yellow (y), magenta (m), cyan (c) and black (k) monochromatic images, one for one. It is structured so that the four image formation stations are aligned in tandem. In operation, yellow, magenta, cyan and black monochromatic images (which may be referred to simply as toner images) are sequentially formed in the four image formation stations, one for one, and are sequentially and temporarily transferred in layers (primary transfer) onto the intermediary transfer belt of the apparatus. Then, the four monochromatic toner images, different in color, on the intermediary transfer belt are transferred together (secondary transfer) onto a sheet of recording medium. Then, the toner images on the sheet of recording medium are fixed to the sheet, yielding thereby a full-color print (including monochromatic print).

Japanese Laid-open patent application 2006-259639 discloses an electrophotographic image forming apparatus structured so that in each of its image formation stations, its primary transfer roller is positioned on the downstream side of the nip (primary transfer nip) between the photosensitive member and intermediary transferring member, by a preset distance, in order to make the primary transfer nip wider in terms of the moving direction of the intermediary transfer member than that of a conventional electrophotographic image forming apparatus.

Japanese Laid-open patent application 2009-98363 also discloses an electrophotographic image forming apparatus structured so that in each of its image formation stations, its primary transfer roller is on the downstream side of the nip (primary transfer nip) between the photosensitive member and intermediary transfer member. More specifically, the apparatus disclosed in this patent application is structured so that the more downstream a given image formation station, the longer it is in the length by which the intermediary transfer belt wraps around the primary transfer roller.

By the way, in a case where the potential level of the intermediary transfer member is higher on the downstream side of the aforementioned nip than on the upstream side of the nip, it is possible that electrical discharge will occur, which affects the quality of an image formed by the apparatus. This type of electrical discharge is more likely to occur on the downstream side of the nip than on the upstream side of the nip.

SUMMARY OF THE INVENTION

Thus, the primary object of the present invention is to provide an electrophotographic image forming apparatus of the tandem type, which is structured so that the primary transfer roller of each of the multiple image formation stations of the apparatus is offset downstream of the primary transfer nip in terms of the moving direction of the intermediary transfer member of the apparatus, and in which electrical discharge does not occur between the image bearing member and intermediary transfer member, on the downstream side of the primary transfer nip.

According to an aspect of the present invention, there is provided an image forming apparatus comprising a movable intermediary transfer member; a first photosensitive member contacting an outer surface of said intermediary transfer member to form a first nip: a second photosensitive member provided downstream of said first photosensitive member with respect to a moving direction of said intermediary transfer member and contacting the outer surface of said intermediary transfer member to form a second nip: a first transfer roller contacting an inner surface of said intermediary transfer member to form a first contact portion at a position away from the first nip toward downstream with respect to the moving direction to transfer a toner image from said first photosensitive member onto said intermediary transfer member in the first nip; and a second transfer roller contacting the inner surface of said intermediary transfer member to form a second contact portion at a position away from the second nip toward downstream with respect to the moving direction to transfer a toner image from said second photosensitive member onto said intermediary transfer member in the second nip, wherein a length of the second contact portion is longer than a length of the first contact portion, measured in the moving direction.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

First Embodiment

First, referring to FIGS. 1-8, the first embodiment of the present invention is described. Incidentally, in a case where a given component, section, etc., of the image forming apparatus in one of the drawings is the same in referential code as the one in another drawing, the two are the same in structure and/or function, and therefore, only one of them will be described to avoid repetition of the same description.

[Image Forming Apparatus]

Figure 1:
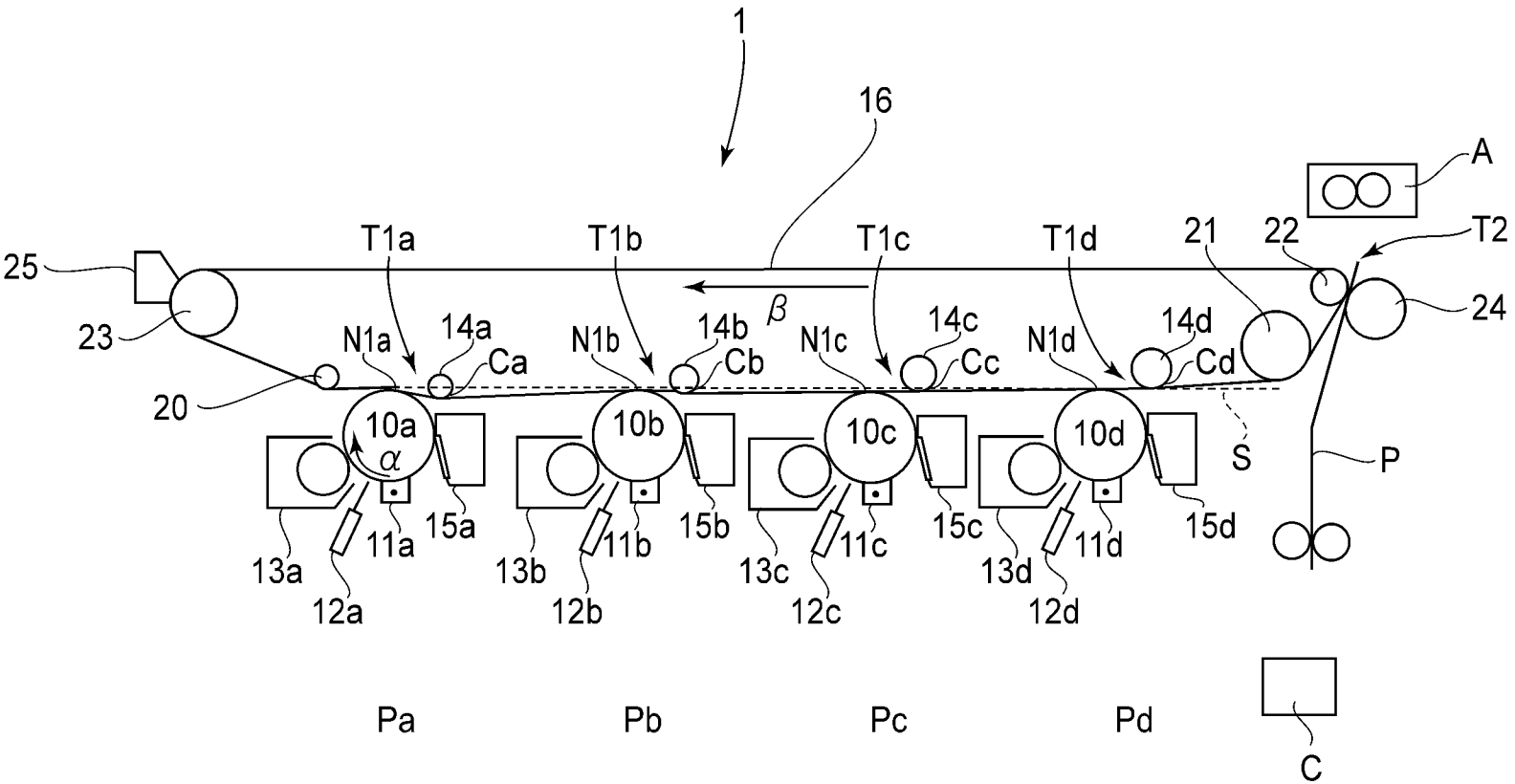
FIG. 1 is a schematic sectional view of the image forming apparatus in the first embodiment of the present invention, and shows the general structure of the apparatus.

First, referring to FIG. 1, the image forming apparatus in accordance with the present invention is described about its general structure. The image forming apparatus 1 is of the so-called tandem type, and also, of the intermediary transfer type. It has multiple (four) image formation stations Pa, Pb, Pc and Pd, in which four monochromatic toner images, different in color, are formed, one for one, with the use of an electrophotographic image formation method. The four colors in which monochromatic toner images are formed in the image formation stations, one for one, correspond to the four primary colors of which an original image is made up. In this embodiment, the four image formation stations are yellow (y), magenta (m), cyan (c), and black image formation stations, listing from the upstream side in terms of the circular movement (indicated by arrow mark β) of the intermediary transfer belt 16.

In this embodiment, the four image formation stations have photosensitive drums 10*a*, 10*b*, 10*c* and 10*d*, one for one. Each drum 10 is an image bearing member, and rotates in the direction indicated by an arrow mark a. Here, picking out a combination of any adjacent two photosensitive drums 10, the upstream one is referred to as the first image bearing member, whereas the downstream one is referred to as the second image bearing member. Each image formation station is provided with electrophotographic devices, which are in the adjacencies of its photosensitive drum.

For example, the image formation stations Pa, Pb, Pc, and Pd have photosensitive drums 10*a*, 10*b*, 10*c*, and 10*d*, respectively. They have also the primary charging devices 11*a*, 11*b*, 11*c* and 11*d*, exposing devices 12*a*, 12*b*, 12*c* and 12*d*, developing devices 13*a*, 13*b*, 13*c* and 13*d*, and cleaning devices 15*a*, 15*b*, 15*c* and 15*d*, which are in the adjacencies of the photosensitive drums 10*a*, 10*b*, 10*c* and 10*d*, respectively. Further, these photosensitive drums 10*a*, 10*b*, 10*c* and 10*d* are parallel to each other, and are in alignment in the circular movement of the intermediary transfer belt 16. The four image formation stations P are the same in basic structure. Here, therefore, only one of them is described without providing the suffix which shows the identity of the station.

The primary charging device 11 charges the peripheral surface of the photosensitive drum 10 to a preset potential level. The exposing device 12 forms an electrostatic latent image on the charged area of the peripheral surface of the photosensitive drum 10 by exposing the charged area of the peripheral surface of the photosensitive drum 10. The developing device 13 stores toner (which is different in color depending on which station it belongs) which develops the electrostatic latent image on the peripheral surface of the photosensitive drum 10 into a visible image (formed of toner, which hereafter is referred to as toner image) with the toner. After the formation of the toner image on the peripheral surface of the photosensitive drum 10, the toner image is transferred (primary transfer) onto the intermediary transfer belt 16; four toner images different in color are sequentially transferred onto the intermediary transfer belt 16. The cleaning device 15 removes the toner remaining on the peripheral surface of the photosensitive drum 10 after the primary transfer.

The primary charging device 11, exposing device 12, and developing device 13 make up a toner image forming means. Hereafter, the toner image forming means which forms a toner image on the photosensitive drum 10, which is equivalent to the aforementioned first image bearing member, is referred to as the toner image forming first means, whereas the toner forming means which forms a toner image on the photosensitive drum 10, which is equivalent to the aforementioned second image bearing member, is referred to as the toner image forming second means.

In order to transfer (primary transfer) a toner image from each photosensitive drum 10 onto the intermediary transfer belt 16, the image forming apparatus 1 is provided with primary transfer rollers 14*a*, 14*b*, 14*c* and 14*d*, which are positioned so that they opposes the photosensitive drums 10*a*, 10*b*, 10*c* and 10*d*, respectively, with the presence of the intermediary transfer belt 16 between the rollers 14*a*, 14*b*, 14*c* and 14*d* and photosensitive drums 10*a*, 10*b*, 10*c* and 10*d*, respectively. Here, the primary roller which opposes the photosensitive drum which is equivalent to the aforementioned image bearing first member is referred to as the first transfer roller, whereas the primary transfer roller which opposes the photosensitive drum which is equivalent to the aforementioned image bearing second member is referred to as the second transfer roller. To each of these primary transfer rollers 14, preset transfer voltages are applied, one for one, whereby the toner images, different in color, formed on the peripheral surface of the photosensitive drums 10 in the image formation stations, one for one, are transferred (primary transfer) onto the intermediary transfer belt 16 in the primary transfer sections T1*a*, T1*b*, T1*c* and T1*d*, one for one.

After being transferred in layers onto the intermediary transfer belt 16, the layered four toner images on the intermediary transfer belt 16 are transferred together (secondary transfer) onto a sheet P of recording medium in the secondary transfer section T2, which is made up of secondary transfer rollers 24 and 22. The secondary transfer roller 24 is on the toner image bearing side of the intermediary transfer belt 16, that is, the outward side of the loop which the intermediary transfer belt 16 forms, and therefore, is referred to as the second transfer outside roller. The secondary transfer roller 22 is inside the loop which the intermediary transfer belt 16 forms, and therefore, is referred to as the secondary transfer inside roller. The secondary transfer inside roller 22 opposes the secondary transfer outside roller 24 with the presence of the intermediary transfer belt 16 between the two rollers 22 and 24. The layered toner images on the intermediary transfer belt 16 are transferred onto a sheet P of recording medium by the application of a preset transfer bias to the secondary transfer outside roller 24.

The secondary transfer inside roller 22 is made up of EPDM rubber, for example. It is 20 mm in diameter, and is 0.5 mm in the thickness of its rubber layer. Its hardness is 70°, for example, in Asker hardness scale C. As for the secondary transfer outside roller 24, it is made up of an elastic layer formed of NBR rubber or EPDM rubber, for example, and a metallic core. It is 24 mm in diameter. It is in connection to a high voltage power source. The bias to be applied to the secondary transfer outside roller 24 can be varied.

The sheet P of recording medium is conveyed into the main assembly of the image forming apparatus 1 by a pickup roller, with a preset timing, from an unshown cassette or tray in which multiple sheets P of recording medium are stored. After being fed into the main assembly of the image forming apparatus 1 by the pickup roller, the sheet P of recording medium is conveyed to the secondary transfer section T2 by a pair of registration rollers with such a timing that it arrives at the secondary transfer section T2 at the same time as the toner images on the intermediary transfer belt 16. Then, the toner images are transferred onto the sheet P of recording medium in the secondary transfer section T2.

After being transferred onto the sheet P of recording medium, the layered four toner images, different in color, on the sheet P are fixed to the sheet P by the heat and pressure to which they are subjected by a fixing device A. The toner, paper dust, and the like contaminants remaining on the intermediary transfer belt 16 after the secondary transfer are removed by an intermediary transfer belt cleaning device 25 positioned downstream of the secondary transfer station T2. The operation of each of the aforementioned devices, portions, etc., is controlled by the control section C of the image forming apparatus 1.

The intermediary transfer belt 16, which is the intermediary transfer member in this embodiment, is made of a substance made by mixing a proper amount of antistatic agent, such as carbon black, in such a resin as polyimide, polyamide, and the like, or one of various rubbers. The volume resistivity of the intermediary transfer belt 16 is in a range of $10^6$-$10^{14}$ Ω/cm. Its thickness is in a range of 0.04-0.1 mm. It is in the form of an endless belt. Its surface resistivity is desired to be in a range of $10^8$-$10^{14}$Ω/□.

The intermediary transfer belt 16 structured as described above is suspended and kept stretched by multiple rollers, and is circularly moved (rotated) at a preset velocity. More concretely, the aforementioned secondary transfer inside roller 22 doubles as one of the multiple rollers, by which the intermediary transfer belt 16 is suspended and kept stretched. The roller 22 circularly moves the intermediary transfer belt 16 by being driven by a motor which is excellent in stability in speed. In terms of the moving direction of the intermediary transfer belt 16, an idler roller 20 is on the upstream side of the photosensitive drum 10*a*, and an idler roller 21 is on the downstream side of the photosensitive drum 10*d*. In this embodiment, the idler roller 20, which is on the upstream side of the idler roller 21, is referred to as an upstream tension roller. The idler roller 21, which is in the downstream adjacencies of the primary transfer roller 14*d*, is referred to as the downstream tension roller.

Not only does a roller 23 function as a tension roller which provides the intermediary transfer belt 16 with a preset amount of tension, but also, as a roller which prevents the intermediary transfer belt 16 from snaking. Incidentally, the image forming apparatus 1 is structured so that the amount of the tension with which the intermediary transfer belt 16 is provided by the roller 23 (tension roller) falls within a range of 3-10 kgf (≈30-100 N).

Each of the primary transfer rollers 14 is a rigid roller, and is made of a metallic substance such as SUM or SUS. To each primary transfer roller 14, an electric voltage which is opposite in polarity to the intrinsic toner polarity is applied, whereby the toner images on the photosensitive drums 10, one for one, are electrostatically attracted by the intermediary transfer belt 16, being thereby sequentially transferred in layers onto the intermediary transfer belt 16. As a result, a full-color toner image is effected on the intermediary transfer belt 16. The metallic roller is straight in terms of its thrust direction, and its diameter is in a range of 6-10 mm. By the way, it is not mandatory that the aforementioned rigid roller, which is employed as the primary transfer roller 14 in this embodiment, is a metallic roller, the peripheral surface of which is bare. That is, a metallic roller, the peripheral surface of which is covered with a thin layer of rubber, may be included as the rigid roller employable as the primary transfer roller 14.

[Primary Transfer Section]

Figure 2:
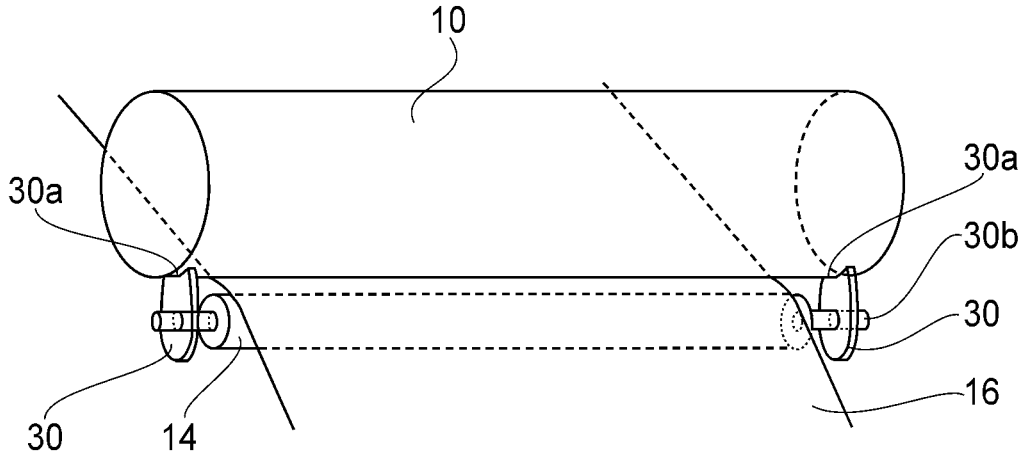
FIG. 2 is a perspective view of the photosensitive drum and primary transfer roller of the apparatus shown in FIG. 1, and shows the structural arrangement which keeps the primary transfer roller precisely positioned relative to the photosensitive drum.
Figure 3:
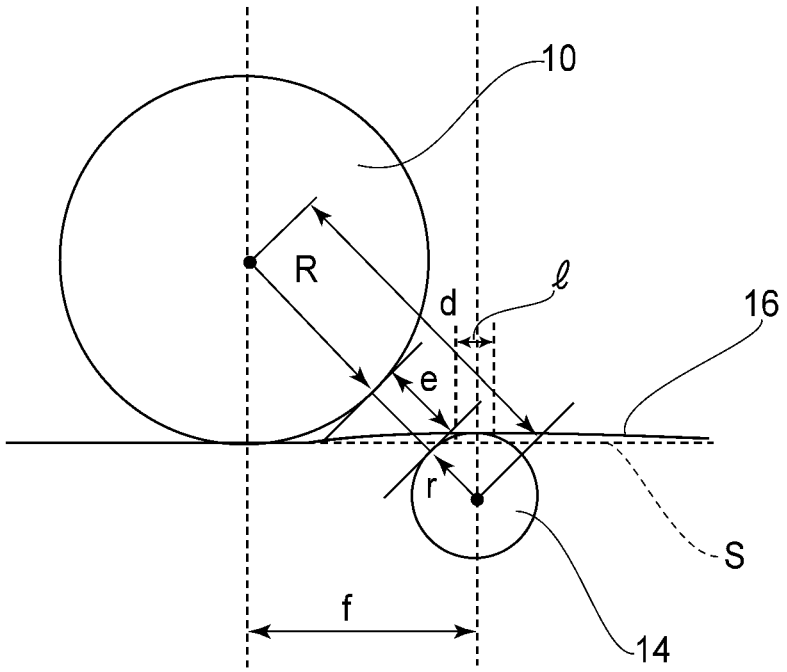
FIG. 3 is a schematic sectional view of one of the primary transfer stations of the image forming apparatus in the first embodiment.

Next, referring to FIGS. 1, 2 and 3, the primary transfer stations in this embodiment are described. In this embodiment, a metallic roller, which is a rigid roller, is used as the primary transfer roller 14 as described above. Therefore, each primary transfer roller 14 is positioned downstream of the corresponding photosensitive drum 10 as shown in FIG. 1. That is, in terms of the moving direction of the intermediary transfer belt 16, the areas of contact Ca, Cb, Cc and Cd between the primary transfer rollers 14*a*, 14*b*, 14*c* and 14*d* and the intermediary transfer belt 16, respectively, are downstream of the nips N1*a*, N1*b*, N1*c* and N1*d*, which are the areas of contact between photosensitive drums 10*a*, 10*b*, 10*c* and 10*d* and intermediary transfer belt 16, respectively. In other words, in terms of the moving direction of the intermediary transfer member, the nips N1*a*, N1*b*, N1*c* and N1*d* do not coincide with the areas of contacts Ca, Cb, Cc and Cd, respectively. Further, the four image formation stations are made different in the amount of the theoretical intrusion of the primary transfer roller 14 into the intermediary transfer belt 16, by varying the four stations different in the position of their primary transfer roller 14 relative to their photosensitive drum 10 in terms of the moving direction of the intermediary transfer belt 16. That is, the image forming apparatus 1 is structured so that the more downstream a given image formation station is in terms of the moving direction of the intermediary transfer member, the less in the amount of theoretical intrusion of the primary transfer roller 14 into the intermediary transfer belt 16, as will be described later. Next, the structure of the image forming apparatus 1 is concretely described.

First, referring to FIG. 2, the distance between the peripheral surface of the photosensitive drum 10 and the peripheral surface of the primary transfer roller 14 is controlled by structuring the image forming apparatus 1 in such a manner that a pair of bearings 30, which are for rotatably supporting the primary transfer roller 14, are kept pressed upon the lengthwise end portions of the photosensitive drum 10, one for one, that is, the portions of the photosensitive drum 10, on which no image is formed. That is, the pair of bearing 30 are attached to the unshown stationary portions of the main assembly of the image forming apparatus 1 in such a manner that the distance between the pair of bearings 30 and the peripheral surface of the photosensitive drum 10 can be adjusted, and also, that the pair of bearings 30 are kept pressured toward the photosensitive drum 10. Further, the bearings 30 support the primary transfer roller 14 by the lengthwise end portions of the shaft of the roller 14, one for one. That is, the pair of bearings 30 support the lengthwise end portions of the shaft of the primary transfer roller 14, one for one, in the areas outside the path of the intermediary transfer belt 16 in terms of the widthwise direction of the intermediary transfer belt 16. Further, the pair of bearings 30 precisely position the primary transfer roller 14 by being kept in contact with the lengthwise end portions of the peripheral surface of the photosensitive drum 10, one for one, with the presence of the intermediary transfer belt 16 between the pair of bearings 30.

The portion of each bearing 30, which faces the photosensitive drum 10, is provided with a recess 30*a*, which is shaped so that its cross-section at a plane perpendicular to the axial line of the bearing 30, is in the form of an arc, the curvature of which is the same as, or slightly greater than, that of the lengthwise end portions of the photosensitive drum 10. Therefore, as the pair of bearings 30 are kept pressed upon the lengthwise end portions of the photosensitive drum 10 by their portion having the recess 30*a*, they are precisely positioned, and kept precisely positioned, relative to the photosensitive drum 10.

As for the position of each primary transfer roller 14 relative to the corresponding photosensitive drum 10 in terms of the moving direction of the intermediary transfer belt 16, it is controlled as follows. First, referring to FIG. 3, it is assumed that a given photosensitive drum 10 and corresponding primary transfer roller 14 are R and r, respectively, in radius, and also, that the distance between the rotational axis of the photosensitive drum 10 and that of the corresponding primary transfer roller 14 is d. The image forming apparatus 1 is structured so that an inequality: d>R+r is satisfied; that is, each primary transfer roller 14 is positioned a preset distance downstream of the corresponding photosensitive drum 10 in terms of the moving direction of the intermediary transfer belt 16.

Further, the image forming apparatus 1 is structured so that the more downstream a given image formation station is in terms of the moving direction of the intermediary transfer belt 16, the smaller it is in the amount of theoretical intrusion of the primary transfer roller 14 into the intermediary transfer belt 16. Referring to FIGS. 1 and 3, here, the amount of "theoretical intrusion" of the primary transfer roller 14 means the distance by which the primary transfer roller 14 presses the intermediary transfer belt 16 in the direction perpendicular to a hypothetical plane S which is tangential to the primary transfer roller side of the peripheral surface of the photosensitive drum 10, beyond the hypothetical plane S. In other words, the amount by which the primary transfer roller 14 presses the intermediary transfer belt 16 beyond the hypothetical plane S, is equivalent to the amount of "hypothetical intrusion". That is, the hypothetical plane S is tangential to both the primary transfer roller side of the photosensitive drum 10 and the photosensitive drum side of the primary transfer roller 14.

In this embodiment, the image forming apparatus 1 is structured so that of any adjacent two primary transfer rollers 14, the second transfer roller (downstream transfer roller) is smaller in the amount of the "hypothetical intrusion" than the first transfer roller (upstream transfer roller). That is, the positional relationship between each primary transfer roller 14 and the corresponding photosensitive drum 10 are set so that the more downstream a given image formation station, the smaller it is in the amount of the hypothetical intrusion of the primary transfer roller 14 into the intermediary transfer belt 16.

Referring to FIG. 3, it is assumed that the distance e between the photosensitive drum 10 and primary transfer roller 14 is set to 0.8 mm, 0.7 mm, 0.6 mm and 0.5 mm, for the image formation stations, Pa, Pb, Pc and Pd, respectively. Further, in terms of the moving direction of the intermediary transfer belt 16, all primary transfer rollers 14 are positioned downstream of the corresponding photosensitive drums 10 by an amount f (6 mm in this embodiment). This amount f is the distance between a line drawn in such a manner that it coincides with the rotational axis of the photosensitive drum 10 and is perpendicular to the hypothetical plane S, and a line drawn in such a manner that it coincides with the axial line of the corresponding primary transfer roller 14 which is on the downstream side of the photosensitive drum 10 and is perpendicular to the hypothetical plane S. Incidentally, a referential code r2 in FIG. 3 stands for the external diameter of the primary transfer roller 14.

The above described distance e may be set to a value in a range of 0.5-2.0 mm so that the more upstream it is, the smaller the distance e. Further, the above described amount of the off-set of a primary transfer roller may be set to a value in a range of 2-10 mm. Moreover, the four image formation stations may be made different in the amount of the off-set of a primary transfer roller, as long as the above described conditions can be met.

Further, in this embodiment, the image forming apparatus 1 is structured so that the more downstream a given image formation station, the greater it is in the amount by which the intermediary transfer belt 16 wraps around a primary transfer roller 14. More concretely, the more downstream a given image formation station, the greater it is in the primary transfer roller diameter. That is, the second primary transfer roller was made greater in external diameter than the first primary transfer roller so that the amount by which the intermediary transfer belt 16 wraps around the second transfer roller (downstream primary transfer roller) became greater than the amount by which the intermediary transfer belt 16 wraps around the first primary transfer roller (upstream primary transfer roller). In this embodiment, therefore, the most downstream primary transfer roller 14*d* is largest in external diameter among the four primary transfer rollers 14.

The idler roller 21, that is, the tension roller which is in the downstream adjacencies of the primary transfer roller 14*d*, is positioned slightly away from the hypothetical plane S in the opposite direction from the photosensitive drum 10, so that the amount l (length of area of contact) by which the intermediary transfer belt 16 wraps around the primary transfer roller 14*d* (most downstream primary transfer roller) becomes greater than the amount by which the intermediary transfer belt 16 wraps around the primary transfer roller 14*d* in a case where the primary transfer roller 14*d* is not positioned slightly away from the hypothetical plane S in the opposite direction from the photosensitive drum 10. Here, the amount l by which the intermediary transfer belt 16 wraps around the primary transfer roller 14*d* means the length of the area of contact between the intermediary transfer belt 16 and primary transfer roller 14*d* in terms of the moving direction of the intermediary transfer belt 16.

[Toner]

Next, the toner used in this embodiment is described. In this embodiment, particled toner made by pulverization is used as the toner in the developer. It contains wax for oil-less fixation. More specifically, it is made by mixing binder resin, wax, coloring agent, antistatic agent, charge prevention agent, kneading the mixture, pulverizing the mixture, and classifying the particles obtained by the pulverization. Incidentally, the method for making the toner does not need to be limited to the above-described one. For example, the toner may be made by putting the above listed ingredients through the processes of kneading, freezing, and pulverization. Further, it may contain additives other than the above listed ones. In any case, toner, such as the one in this embodiment, which is made by pulverization and contains wax, can be relatively inexpensively manufactured in comparison to the other types of toner, for example, toner manufactured by polymerization.

However, in the case of the toner manufactured by pulverization, wax is likely to be near the surface layer of a toner particle, and therefore, is likely to seep out and adhere to a development sleeve. Thus, toner particles manufactured by pulverization are more likely to agglomerate than toner particles manufactured by other methods.

The toner used in this embodiment is a toner which was manufactured by pulverization and contains wax. It is in a range of 15-50% in agglomeration ratio. Next, the method used in this embodiment to measure the toner particle agglomeration ratio is described. The agglomeration ratio is one of the means for indicating the fluidity of a test subject (toner). That is, it is assumed that the greater a test subject in agglomeration ratio, the worse the test subject in fluidity. The apparatus used for measuring the agglomeration ratio of the toner used in this embodiment was a powder tester (product of Hosokawa Micron Co., Ltd).

As for the method used to measure the toner used in this embodiment, a vibration table is fitted with a 200 mesh screen, a 100 mesh screen, and a 60 mesh screen. The screens are positioned in the order of opening size so that the 60 mesh screen, that is, the screen which is smallest in opening size, is placed at the top. Then, precisely 5 grams of test subject (toner) is placed on the 60 mesh screen. Then, the vibration table is set so that it becomes 21.7 V in input voltage, and its vibratory amplitude falls within a range of 60-90 μm (2.5 in rheostat scale). Then, the table is vibrated for roughly 15 seconds. Thereafter, the amount of test subject (toner) remaining on each screen is measured in weight. Then, the agglomeration ratio is obtained with the use of the following equation:

Agglomeration ratio=(weight g of sample on 60 mesh screen)×100/5g+((weight g of sample on 100 mesh screen)×100/5g)×⅗+((weight g of sample on 200 mesh screen)×100/5g)×⅕.

Since the image forming apparatus 1 in this embodiment is structured as described above, it is significantly smaller in the frequency with which a tiny part or parts of the toner image on the intermediary transfer belt 16 fail to be transferred onto a sheet of recording medium in the second transfer station, even when toner which was manufactured by pulverization and contains wax is used. That is, in this embodiment, the image forming apparatus 1 is structured so that the more downstream a given image formation station, the smaller it is in the amount of the hypothetical intrusion of the primary transfer roller 14 into the intermediary transfer belt 16, and therefore, the smaller the contact pressure between the intermediary transfer belt 16 and photosensitive drum 10. Thus, the more downstream a given image formation station, the smaller the pressure to which the layered toner images are subjected while they are conveyed through the area of contact between the intermediary transfer belt 16 and photosensitive drum 10. Therefore, even in the image formation station 4*d*, that is, the most downstream image formation station, which is the largest in the number of the layered toner image, toner particles are unlikely to agglomerate. Therefore, it is unlikely for the image forming apparatus 1 to output images which suffer from unwanted spots attributable to the transfer failure in the secondary transfer station.

Figure 4:
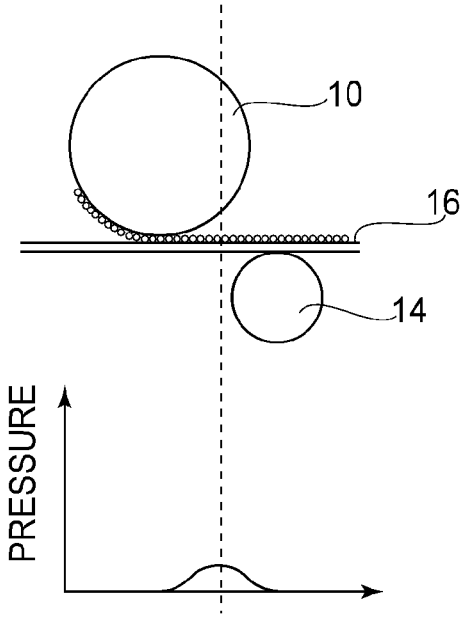
FIG. 4 is a combination of a sectional view of the photosensitive drum 10 and primary transfer roller 14, of the image forming apparatus in the first embodiment, and their adjacencies, and a graph which shows the pressure distribution in the primary transfer nip of each image formation station of the apparatus.
Figure 5:
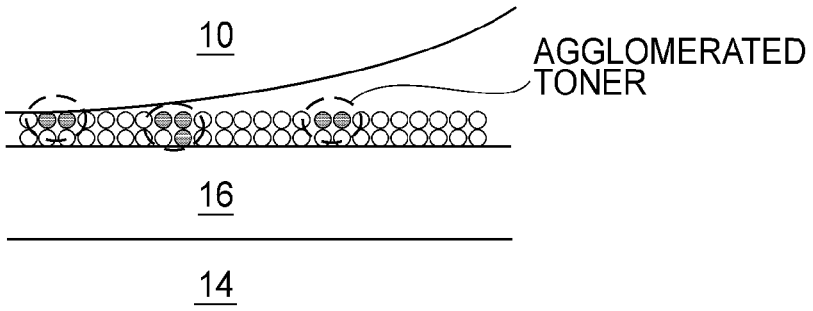
FIG. 5 is a schematic drawing for describing toner agglomeration.

Next, referring to FIGS. 4 and 5, the above described phenomenon called a "transfer spot" is described. It has been confirmed that a "transfer spot" is likely to occur when a sheet of recording medium which is inferior in texture is used as recording medium. That is, a "transfer spot" is attributable to a phenomenon that a toner image or images on the intermediary transfer belt 16 fail to be properly transferred onto a sheet P of recording medium, resulting thereby in the formation of an image which suffers from unwanted spots. It has been known that the occurrence of this phenomenon is attributable to various causes. Further, it has been confirmed that one of the causes is the pressure (peak pressure) which works between the photosensitive drum 10 and intermediary transfer belt 16.

FIG. 4 shows the pressure distribution between the photosensitive drum 10 and primary transfer roller 14. This pressure distribution is affected by the positional relationship between the photosensitive drum 10 and primary transfer roller 14. That is, it is likely that the greater the amount of hypothetical intrusion of the primary transfer roller 14, the greater the pressure which works in the area (primary transfer station T1) between the photosensitive drum 10 and primary transfer roller 14. Further, after the transfer of toner images onto the intermediary transfer belt 16, the toner particles in a part or parts (surrounded by dotted line, for example) of toner images on the intermediary transfer belt 16 are likely to be made to agglomerate, as shown in FIG. 5, by the pressure which works in the primary transfer station T1. Once certain number of toner particles agglomerate into a lump, this lump is unlikely to be properly transferred onto recording medium in the secondary transfer station T2, and therefore, likely to make the image forming apparatus 1 output an image which suffers from unwanted spots. In particular, in this embodiment which uses such toner that was manufactured by pulverization, contains wax, and is in a range of 15%-50% in agglomeration ratio, toner particle agglomeration is likely to occur. Therefore, unless the pressure which works in the primary transfer station is properly controlled, it is likely for the image forming apparatus 1 to output images which suffer from unwanted transfer spots.

In addition, in the case of an electrophotographic image forming apparatus of the tandem type, such as the one in this embodiment, the more downstream a given image formation station, the greater it is in the number by which toner images are layered on the intermediary transfer belt 16, and therefore, the higher in probability of the occurrence of toner agglomeration. Therefore, the image forming apparatus 1 in this embodiment is structured so that the more downstream a given primary transfer station, the smaller it is made in the pressure which works in the primary transfer station T1, as described above. Therefore, toner agglomeration is unlikely to occur even in the most downstream primary transfer station. Therefore, the image forming apparatus 1 in this embodiment is unlikely to output images which suffer from the above described transfer spots.

On the other hand, if the pressure (peak pressure) between the photosensitive drum 10 and primary transfer roller 14 is lower than a certain value, it is possible that as an image is transferred onto the intermediary transfer belt 16 in the primary transfer station, the so-called "leopard spot pattern" is effected upon the transferred image on the intermediary transfer belt 16, in the downstream adjacencies of the area of contact between the peripheral surface of the photosensitive drum 10 and intermediary transfer belt 16. Next, referring to FIGS. 6-8, this "leopard spot pattern" is described.

Figure 6:
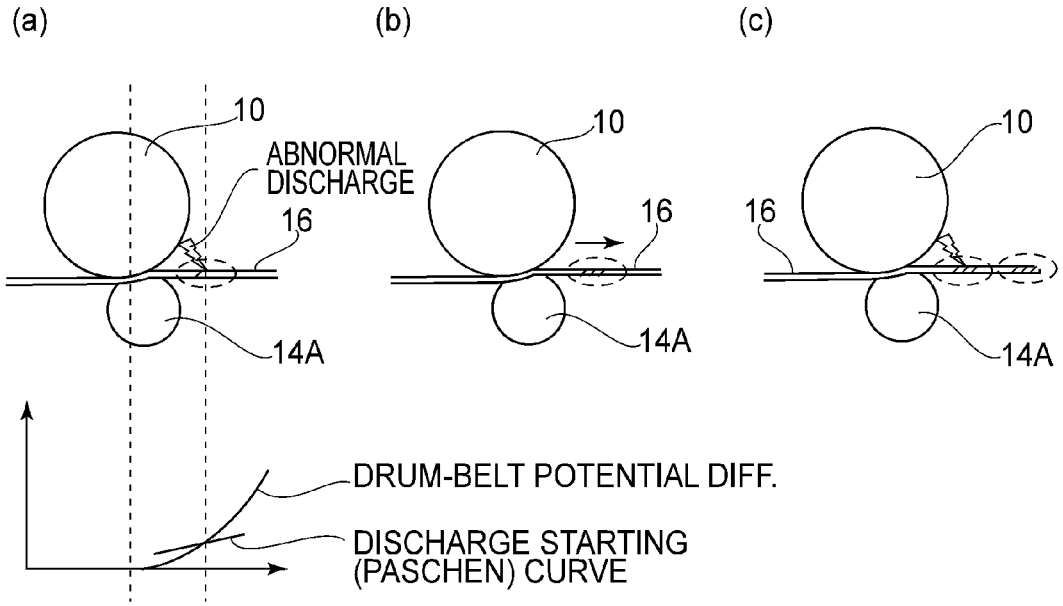
FIG. 6 is a drawing for describing the mechanism of the formation of an image having "leopard spots".

First, the mechanism of the occurrence of the "leopard spots" is described. FIG. 6 is a schematic drawing for describing the process through which the "leopard spots" occur in the downstream adjacencies of the primary transfer roller 14A having an elastic surface layer formed of elastic substance such as sponge. Referring to FIG. 6(*a*), as the potential level of the intermediary transfer belt 16 becomes higher than a certain value in the downstream adjacencies of a given image formation station, abnormal electrical discharge occurs between the photosensitive drum 10 and intermediary transfer belt 16. This electric discharge generates the "spotty pattern" across the areas of the image, which correspond in position to the electric discharge. Then, the areas of the image, which have been given the "spotty pattern" are moved downstream by the movement of the intermediary transfer belt 16 as shown in FIG. 6(*b*). As the areas of the image, which have given the "spotty pattern" are moved downstream by a certain distance by the movement of the intermediary transfer belt 16, the downstream adjacencies of the primary transfer roller 14 satisfies again the condition in which the abnormal electrical discharge occurs, and therefore, electrical discharges occur as shown in FIG. 6(*c*), giving the spotty pattern to the areas of the image, which correspond in position to the electrical discharges. With the repetition of the processes shown in FIGS. 6(*a*)-6(*c*), the transferred image on the intermediary transfer belt 16 is given an abnormal pattern called "leopard pattern". This phenomenon occurs also in a case where a metallic roller is used as the primary transfer roller, as in this embodiment.

Figure 7:
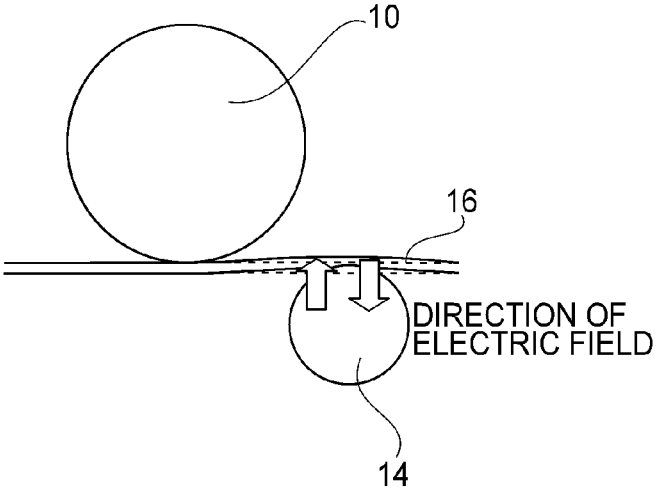
FIG. 7 is a schematic drawing for describing the direction of the electric field which occurs between the intermediary transfer belt and primary transfer roller.

Here, the reason why the intermediary transfer belt 16 becomes excessively high in potential level in the downstream adjacencies of the primary transfer station is described. Referring to FIG. 7, in the area of contact between the primary transfer roller 14 and intermediary transfer belt 16, an electric field which works in the primary transfer roller 14-to-intermediary transfer belt 16 direction, and a reverse electric field, that is, an electric field which works in the intermediary transfer belt 16-to-primary transfer roller 14 direction, occur. In such an area of contact, the electric charge of toner and the excessive electric charge other than the electric charge of toner are supplied from the primary transfer roller 14 to the intermediary transfer belt 16. However, because of the presence of the reverse electric field, the excessive electric charge is returned to the primary transfer roller 14. Therefore, only the electric charge of toner moves downstream of the intermediary transfer belt 16, along with the toner.

Figure 8:
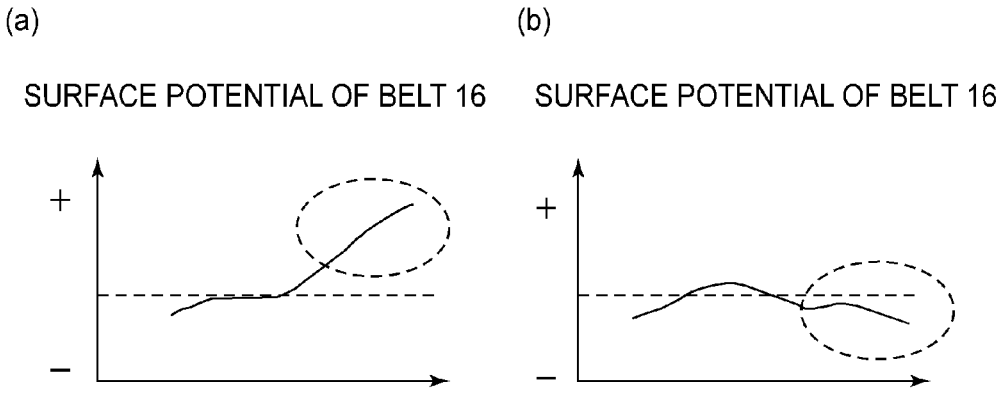
FIGS. 8(*a*) and 8(*b*) are graphs which show the relationship between the surface potential level of the intermediary transfer belt 16, on the upstream side of the primary transfer station, and the surface potential level in the downstream adjacencies of the primary transfer station.

If the area of contact between the peripheral surface of the primary transfer roller 14 and intermediary transfer belt 16 is not large enough, the reverse electric field does not occur, allowing the excessive electric charge to flow into the intermediary transfer belt 16. Therefore, the intermediary transfer belt 16 is likely to become high in potential level in the downstream adjacencies of the primary transfer station as shown in FIG. 8(*a*), and therefore, the "leopard spots" are effected. In comparison, when the area of contact between the primary transfer roller 14 and intermediary transfer belt 16 is substantial, the excessive electric charge is returned by the effect of the reverse electric field, and therefore, the intermediary transfer belt 16 is prevented from increasing in potential level in the downstream adjacencies of the primary transfer station. Therefore, the "leopard pattern" is not generated. Further, the more downstream a given image formation station, the greater in the tendency that the excessive electric charge collects, and therefore, the greater in the tendency that the "leopard spots" are generated. Therefore, the more downstream a given primary transfer station, the greater it must be in the area of contact between the primary transfer roller 14 and intermediary transfer belt 16.

Further, in a case where the image forming apparatus 1 is structured so that the more downstream a given image formation station as described above, the smaller it is in the amount of pressure which works between the primary transfer roller 14 and intermediary transfer belt 16, it is likely that the more downstream a given image formation station, the greater it is in the likelihood that the "leopard pattern" will occur, unless some measures are taken. That is, simply reducing the amount of the hypothetical intrusion of the primary transfer roller 14 into the intermediary transfer belt 16 reduces the area of contact between the primary transfer roller 14 and intermediary transfer belt 16, making it more likely that the more downstream a given image formation station, the more likely for the station to generate the "leopard pattern".

In this embodiment, therefore, the image forming apparatus 1 is structured so that the more downstream a given image formation station, the greater it is made in the amount by which the intermediary transfer belt 16 wraps around the primary transfer roller 14, and therefore, the greater it is made in the area of contact between the primary transfer roller 14 and intermediary transfer belt 16. Therefore, even in the most downstream image formation station, the reverse electric field is generated between the primary transfer roller 14 and intermediary transfer belt 16, and therefore, it is easier for the excessive amount of electric charge to be returned to the primary transfer roller 14. Therefore, it is unlikely for the "leopard pattern" to be generated even in the most downstream image formation station.

If it is the only concern to reduce in probability the generation of the "leopard spots", it is possible to increase all image formation stations in the amount by which the intermediary transfer belt 16 wraps around the primary transfer roller 14. However, increasing all image formation stations in the amount by which the intermediary transfer belt 16 wraps around the primary transfer roller 14 makes the intermediary transfer belt 16 unstable in the manner in which the intermediary transfer belt 16 circularly moves, which in turn may cause the image forming apparatus 1 to output images which suffer from such a defect as the positional deviation of fine lines or the like. Therefore, it is desired, from the standpoint of the stability in the movement of the intermediary transfer belt 16, that the image forming apparatus 1 is structured, as in this embodiment, so that the more downstream a given image formation, the greater it is in the amount by which the intermediary transfer belt 16 wraps around the primary transfer roller 14 (length of area of contact between photosensitive drum 10 and intermediary transfer belt 16), in proportion to the probability with which the "leopard spots" will be generated.

As described above, in this embodiment, the image forming apparatus 1 is structured so that the more downstream a given image formation station is, the smaller it is in the amount of hypothetical intrusion of the primary transfer roller 14, and the greater the amount by which the intermediary transfer belt 16 wraps around the primary transfer roller 14. Therefore, not only is the image forming apparatus 1 in this embodiment unlikely to output images which suffer from the "transfer spots" attributable to the primary transfer, but also, it is unlikely to output images which suffer from the "leopard spots". Incidentally, the relationship among the image formation stations in terms of the amount (length of area of contact) by which the intermediary transfer belt 16 wraps around the primary transfer roller 14 is not affected by whether or not the intermediary transfer belt 16 is in motion. Therefore, the amount by which the intermediary transfer belt 16 wraps around the primary transfer roller 14 while the intermediary transfer belt 16 is in motion moved can be obtained by measuring the amount (length of area of contact) by which the intermediary transfer belt 16 wraps around the primary transfer roller 14 while the image forming apparatus 1 is not in operation.

Second Embodiment

Figure 9:
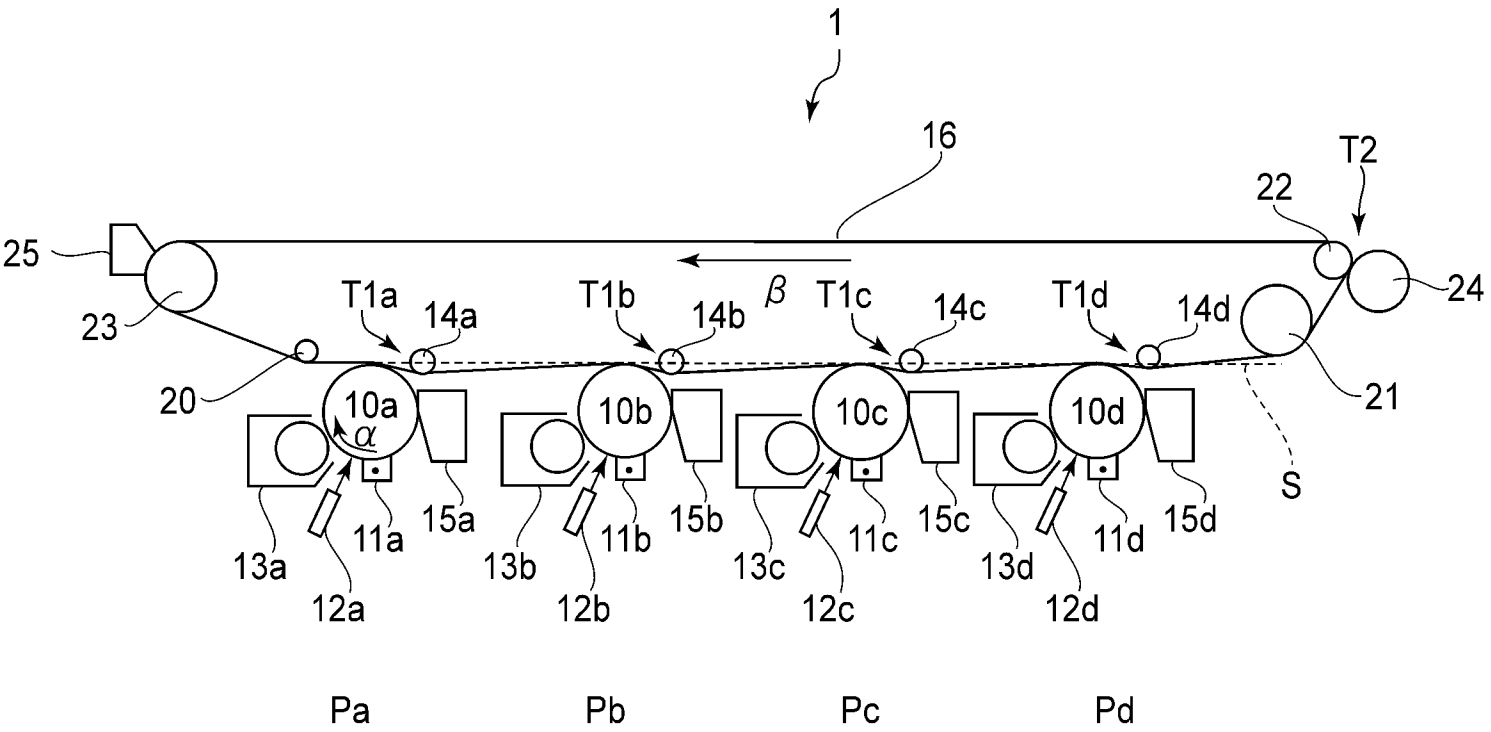
FIG. 9 is a schematic sectional view of the image forming apparatus in the second embodiment of the present invention, and shows the general structure of the apparatus.

Next, referring to FIG. 9, the second embodiment of the present invention is described. In the first embodiment of the present invention described above, the image forming apparatus 1 was structured so that the more downstream a given image formation station, the smaller it is in the amount of the hypothetical intrusion of the primary transfer roller 14 into the intermediary transfer belt 16. In comparison, in this embodiment, the image formation stations Pa, Pb and Pc which are on the upstream side of the image formation station Pd, are made roughly the same in the amount of the hypothetical intrusion of the primary transfer roller 14, and the image formation station Pd, that is, the most downstream image formation, is made smaller in the amount of the hypothetical intrusion of the primary transfer roller 14 than the other image formation stations.

In this embodiment, therefore, the photosensitive drum 10*d* and primary transfer roller 14*d* of the image formation station Pd are equivalent to the second image bearing member and second transfer roller, respectively, and a combination of the primary charging device 11*d*, exposing device 12*d*, and developing device 13*d* of the image formation station Pd is equivalent to the toner image forming second means. On the other hand, the photosensitive drum 10 and primary transfer roller 14 of one of the upstream image formation stations Pa, Pb and Pc are equivalent to the first image bearing member and first transfer roller, and a combination of the primary charging device 11, exposing device 12, and developing device 13 of the same image formation station is equivalent to the toner image forming first means.

Further, the relationship between a combination of three upstream image formation stations Pa, Pb and Pc, and the most downstream image formation station Pd, in terms of the amount by which the intermediary transfer belt 16 wraps around the primary transfer roller 14 is similar to the relationship between a combination of the upstream image formation stations and the most downstream image formation station in terms of the amount of the theoretical intrusion of the primary transfer roller 14. That is, the upstream image formation stations Pa, Pb and Pc are made roughly the same in the amount by which the intermediary transfer belt 16 wraps around the primary transfer roller 14, and the image formation station Pd, or the most downstream image formation station, is made greater in the amount by which the intermediary transfer belt 16 wraps around the primary transfer roller 14 than the other image formation stations.

In this embodiment, therefore, the image forming apparatus 1 is structured so that the primary transfer roller 14*d* is positioned on the opposite side of the hypothetical plane S from the photosensitive drums 10, and farther away from the plane S than the idler 21 (which is downstream tension roller and is on downstream side of primary transfer roller 14*d*). All the primary transfer rollers 14 are the same in external diameter. Otherwise, the image forming apparatus 1 in this embodiment is the same in structure and operation as the above-described image forming apparatus 1 in the first embodiment.

Third Embodiment

Figure 10:
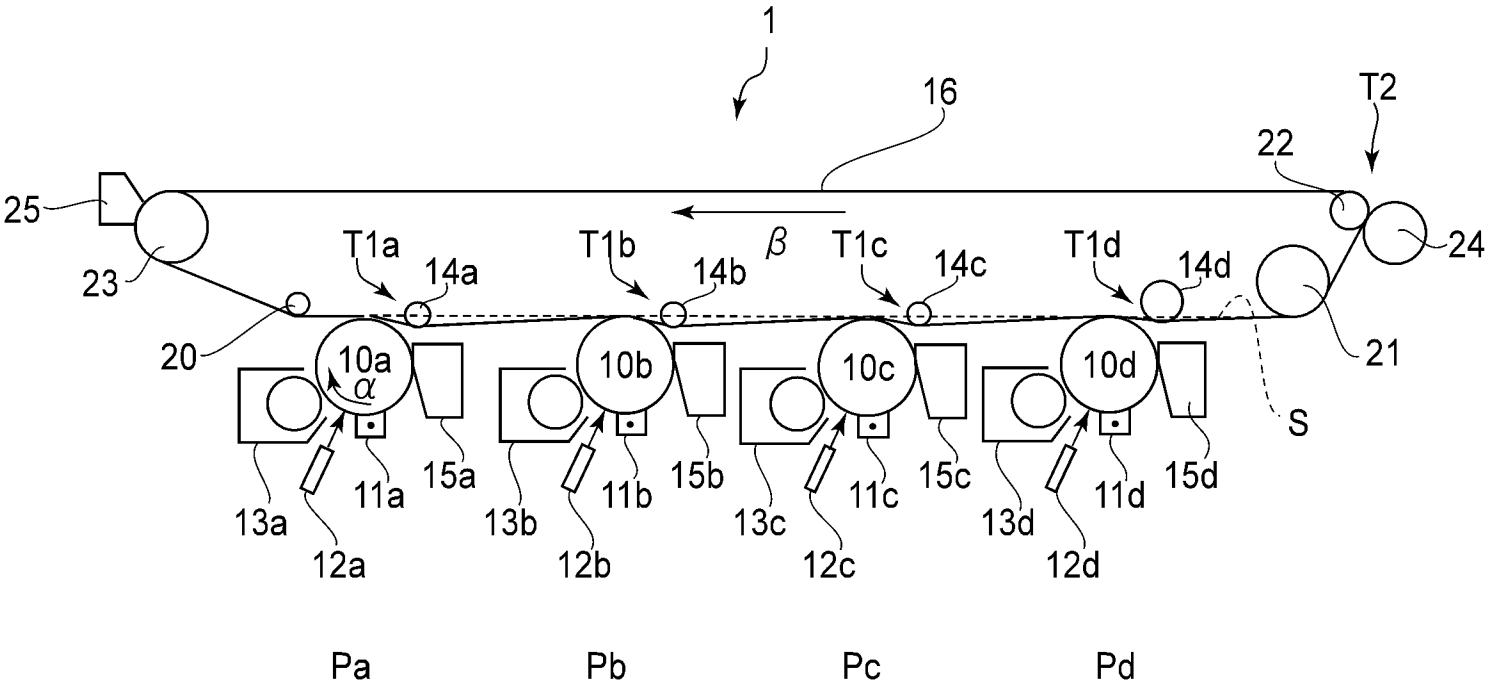
FIG. 10 is a schematic sectional view of the image forming apparatus in the third embodiment of the present invention, and shows the general structure of the apparatus.

Next, referring to FIG. 10, the third embodiment of the present invention is described. In the second embodiment described above, the amount (length of area of contact) by which the intermediary transfer belt 16 wraps around the primary transfer roller 14*d* (most downstream primary transfer roller) was increased by changing the idler roller 21 (downstream tension roller) in position as described above. In comparison, in this embodiment, the amount by which the intermediary transfer belt 16 wraps around the primary transfer roller 14*d* (most downstream primary transfer roller) was made larger than the amount by which the intermediary transfer belt 16 wraps around the primary transfer rollers 14*a*, 14*b* and 14*c*, by making the external diameter r2 of the primary transfer roller 14*d* (most downstream primary transfer roller) larger than the external diameter r2 of the primary transfer roller 14 in each of the image formation stations Pa, Pb and Pc. The positioning of the idler roller 21 is such that the idler roller 21 is on the opposite side of the hypothetical plane S from the photosensitive drums 10, and also, that the peripheral surface of the idler roller 21 coincides with the plane S. Otherwise, the image forming apparatus 1 in this embodiment is the same in structured and operation as the image forming apparatus 1 in the second embodiment.

Miscellanies

The amount by which each primary transfer roller 14 hypothetically intrudes into the intermediary transfer belt 16 may be controlled by controlling the total amount of pressure applied to each primary transfer roller 14 by the springs for pressing the bearings 30, or the like pressure applying means, in the direction to press each primary transfer roller 14 toward the corresponding photosensitive drum 10. In such a case, the image forming apparatus 1 has only to be structured that the more downstream a given image formation station, the weaker the springs of the station. In this case also, the image forming apparatus 1 may be structured so that the image formation stations Pa, Pb and Pc are the same in spring strength, and the image formation station Pd (most downstream station) is less in spring strength than the other.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 121915/2011 filed May 31, 2011 which is hereby incorporated by reference.

What is claimed is:

1. An image forming apparatus comprising:

a movable intermediary transfer member;

a first photosensitive member contacting an outer surface of said intermediary transfer member to form a first nip:

a second photosensitive member provided in a downstream direction of said first photosensitive member with respect to a moving direction of said intermediary transfer member and contacting the outer surface of said intermediary transfer member to form a second nip:

a first transfer roller contacting an inner surface of said intermediary transfer member to form a first contact portion at a position away from the first nip in the downstream direction to transfer a toner image from said first photosensitive member onto said intermediary transfer member in the first nip;

a second transfer roller contacting the inner surface of said intermediary transfer member to form a second contact portion at a position away from the second nip in the downstream direction to transfer a toner image from said second photosensitive member onto said intermediary transfer member in the second nip, wherein said first transfer roller is disposed at such a position that a peripheral surface thereof adjacent to said first and second photosensitive members is located a first amount from a common tangent line, adjacent to said intermediary transfer member, of said first and second photosensitive members, toward said first and second photosensitive members, and said second transfer roller is disposed at such a position that a peripheral surface thereof adjacent to said first and second photosensitive members is located a second amount from the common tangent line toward said first and second photosensitive members, with the second amount being smaller than the first amount, and wherein a length of the second contact portion is longer than a length of the first contact portion, measured in the moving direction, and a supporting roller disposed at a position which is adjacent to and downstream of said second transfer roller and which is disposed such that a peripheral surface thereof is spaced from the common tangent line away from said first and second photosensitive members.

2. An apparatus according to claim 1, wherein an outer diameter of said second transfer roller is larger than an outer diameter of said first transfer roller.

3. An apparatus according to claim 1, wherein a pressure of the second nip is smaller than a pressure of the first nip.

4. An apparatus according to claim 1, wherein said first and second transfer rollers are metal rollers.

* * * * *